United States Patent [19]

Sukup et al.

[11] Patent Number: 4,919,642

[45] Date of Patent: Apr. 24, 1990

[54] ROTARY GRAIN SCREENER

[75] Inventors: Eugene G. Sukup, Hampton; Charles E. Sukup; Steven Sukup, both of Dougherty, all of Iowa

[73] Assignee: Sukup Manufacturing Company, Sheffield, Iowa

[21] Appl. No.: 278,048

[22] Filed: Nov. 30, 1988

[51] Int. Cl.[5] ..... B02S 3/06

[52] U.S. Cl. ..... 460/80; 460/81; 460/82

[58] Field of Search ..... 460/79, 80–83, 460/97, 98, 902; 99/522, 528; 241/69

[56] References Cited

U.S. PATENT DOCUMENTS

| | | | |
|---|---|---|---|
| Re. 717 | 5/1859 | Moffitt | 130/21 |
| 221,453 | 11/1879 | Fisher | 130/2 |
| 323,726 | 8/1885 | Payne | 130/27 |
| 1,617,688 | 2/1927 | O'Toole | 209/284 |
| 2,811,158 | 10/1957 | Rietmann | 130/27 |
| 3,122,499 | 2/1964 | Witzel et al. | 209/21 |
| 3,463,314 | 8/1969 | Feterl | 209/284 |
| 4,440,637 | 4/1984 | Smit et al. | 209/241 |

FOREIGN PATENT DOCUMENTS 2011 of 1878 United Kingdom .

OTHER PUBLICATIONS

Farm Fans, Inc., GC-140 Grain Cleaner brochure.
Feterl Mfg. Co., Rotating Crop Cleaners brochure.
Gilmore & Tatge Mfg. Co., F1080 Grain Cleaner brochure.
Sukup Manufacturing, Model 48 Grain Cleaner brochure.
Modern Farm Systems (MFS) Model 1800 Grain Cleaner brochure.

*Primary Examiner*—Jerome W. Massie, IV
*Assistant Examiner*—Gay Ann Spahn
*Attorney, Agent, or Firm*—Neuman, Williams, Anderson & Olson

[57] ABSTRACT

A rotary grain screener is disclosed in which the primary grain-advancing flighting is mounted on the internal surface of the rotary screener drum and an inner auger is mounted on a central axial drive shaft to advance the grain forward in the drum at a greater rate than is accomplished by the flighting on the internal surface of the drum. The screener drum is supported on the central drive shaft which has a support bearing on the input auger housing and the drum is further provided at the input end with two annular bearing plates which are attached to the end plate of the drum and have a close fit around the input auger housing for closure and support purposes. A single motive power source drives the drive assembly which operates both the input auger and the screener drum.

17 Claims, 3 Drawing Sheets

FIG. 2
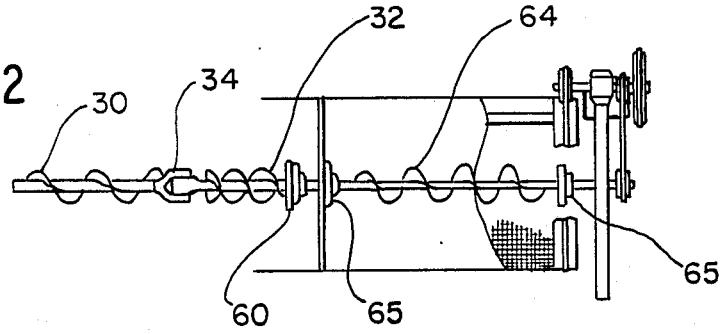
FIG. 1
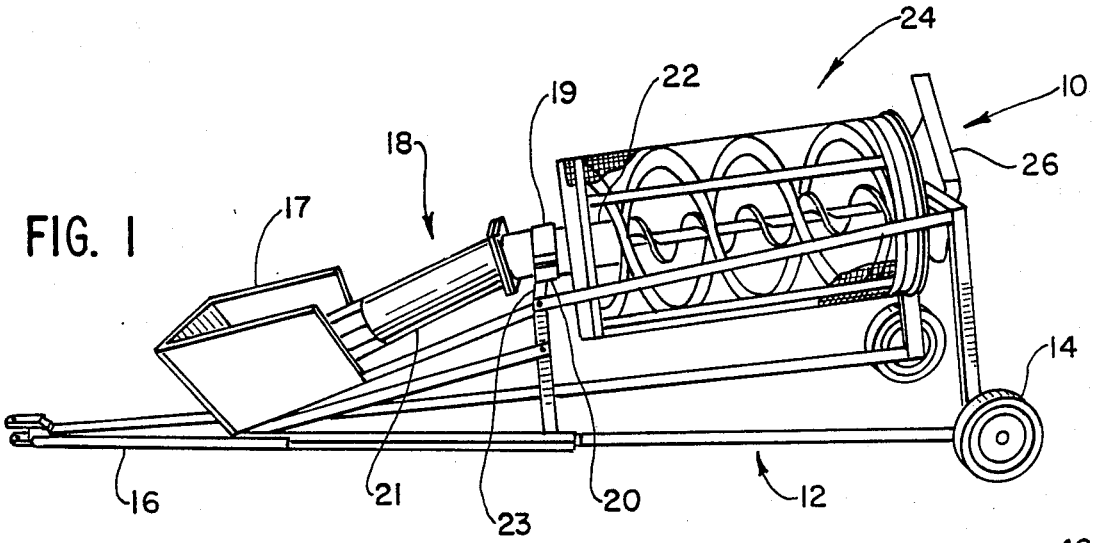
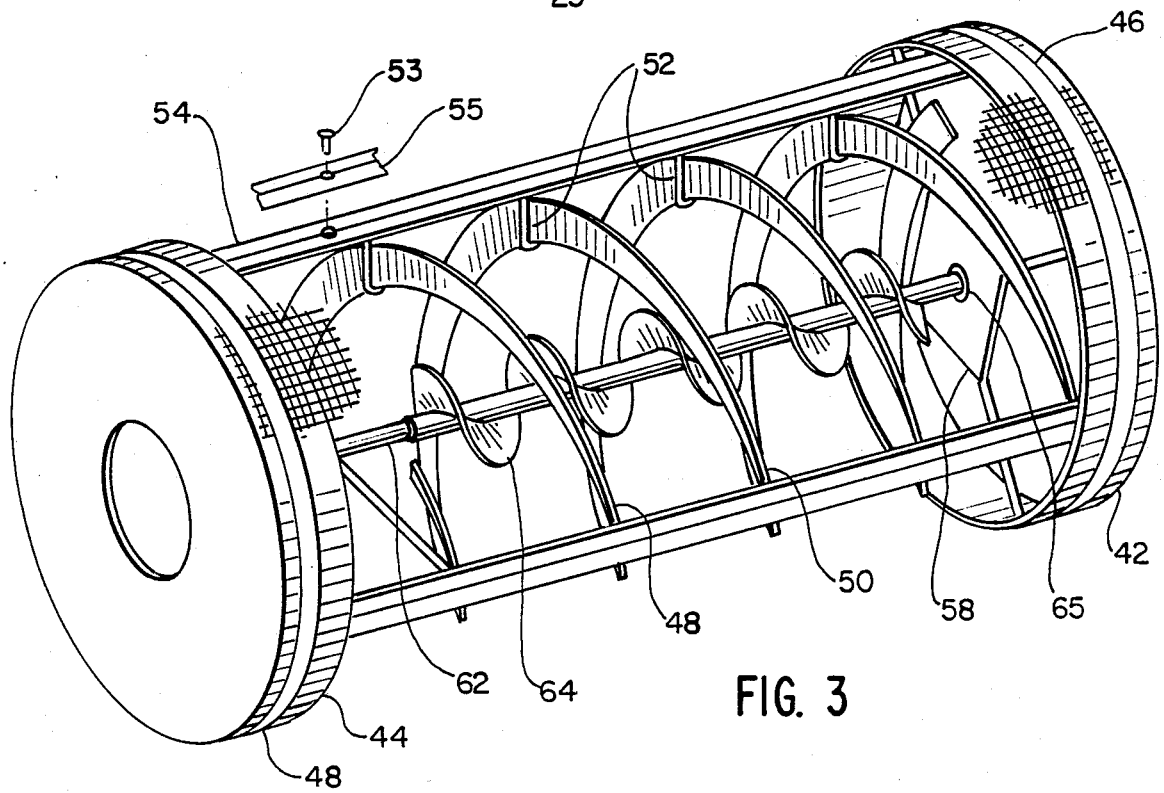
FIG. 3

FIG. 6
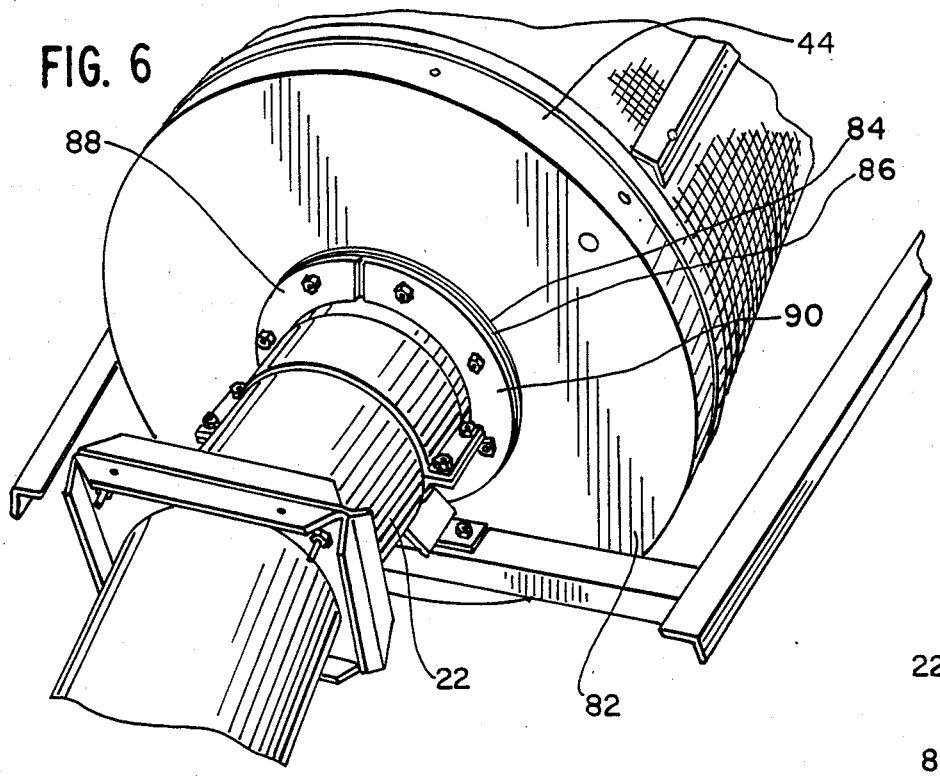
FIG. 7
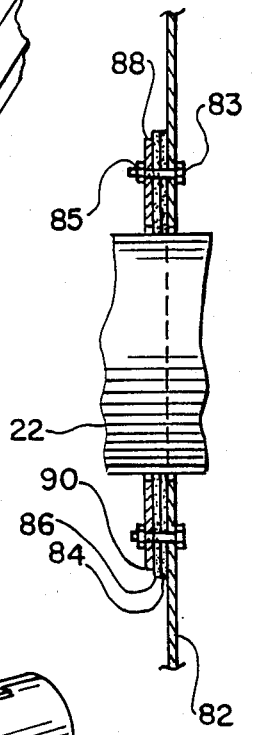
FIG. 8
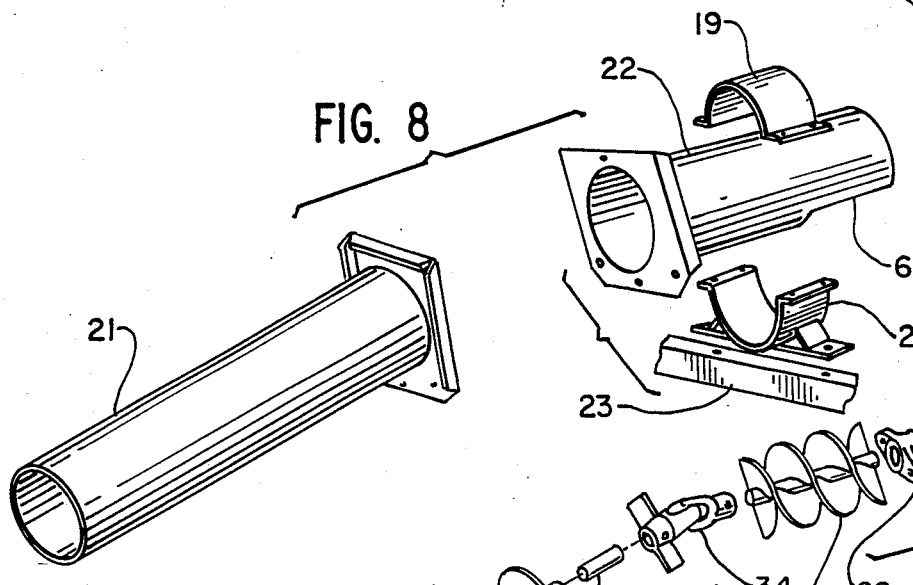
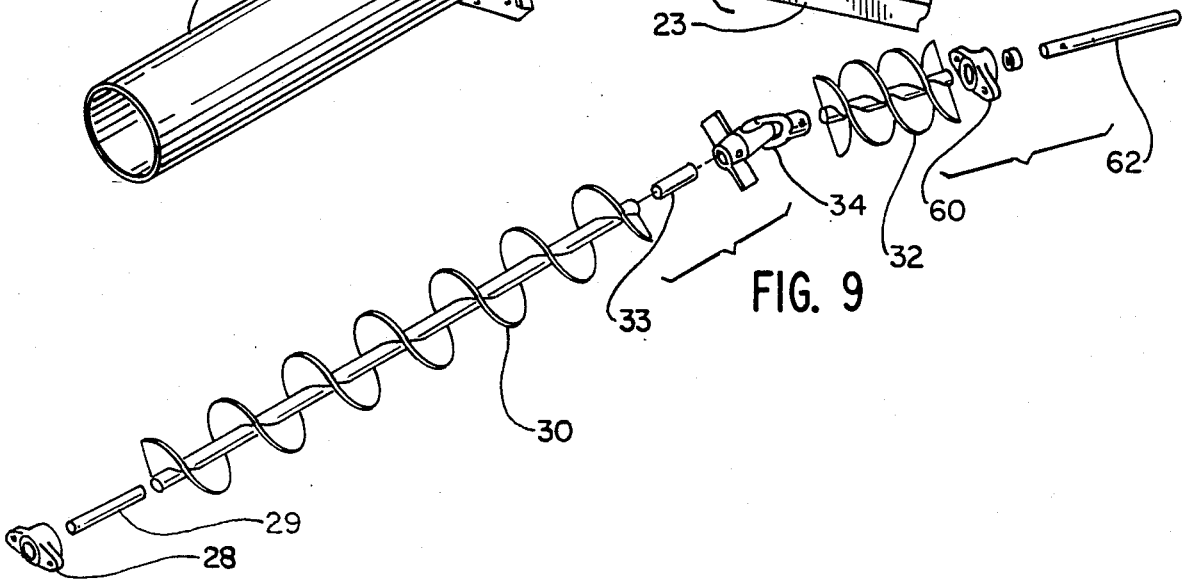
FIG. 9

ROTARY GRAIN SCREENER

This invention relates to rotary grain screeners and more particularly to screeners which remove fine foreign particles from grains. The screeners of the invention are very efficient while being rugged and highly reliable. They are relatively simple and use a minimum number of component parts which may be readily assembled. Therefore, the screeners are economical to manufacture and also easy to clean and service.

BACKGROUND OF THE INVENTION

Grain that has been processed by a threshing machine, such as a combine, frequently contains undesired foreign particles such as weed seeds, chaff, broken kernels and other foreign particles which it is very desirable to remove prior to storing the grain for use or sale. Such extraneous fine materials interfere with air flow when the grain is being dried and stored and can cause areas of spoiled grain.

Screeners for cleaning grain and the like have included one or more rotary screens to separate the grain from foreign materials. In one type of screener, the outer drum includes a cylindrical screen supported by a plurality of axially spaced rims. The grain to be cleaned is supplied into the drum which has a fine mesh screen to allow fine foreign materials to pass the screen. The grain collected in the fine mesh screen is removed from one end of the drum.

In one type of construction, an auger conveyor extends longitudinally within a rotary, cylindrical screen and an elongate baffle member is disposed in the space between the auger conveyor and the screen and encloses only a portion of the auger conveyor. In addition, an auger conveyor element is mounted on the outside of the separating screen and rotatable therewith. Drive means are provided for rotating the drum and the auger conveyor.

SUMMARY OF THE INVENTION

This invention was evolved with the general object of improving upon prior rotary grain screeners, increasing the efficiency thereof while also providing screeners which are easy to use and which at the same time are inexpensive to manufacture, rugged and reliable.

An important feature of the invention is that the primary grain-advancing flighting is mounted on the internal surface of the screening drum. This outer flighting advances the grain along the separating screen which insures continuous movement of the grain and enhances the separation of the fine foreign material from the grain.

Another important feature is the combination of the outer conveyor flighting on the screening drum and the inner conveyor flighting on the central drive shaft with the inner flighting operating at a greater angular velocity than the outer flighting. The inner conveyor flighting moves and spreads the grain forward in the drum at a greater rate than is accomplished by the outer conveyor flighting. This combination provides continuous movement of the grain along the separating screen which enhances the separation of the fine foreign material from the grain.

Another feature of the screener is the load bearing mounting of the screener drum on the input auger housing. In a grain screener constructed in accordance with the invention, the screener drum is supported by a number of radial spokes joined to a center plate attached to a bearing mounted on the central shaft. In addition, the screener drum is supported on the input auger housing. The support assembly at the input auger housing has two annular plates which are attached to the end plate of the drum and have a close fit around the input auger housing which provides a bearing engagement on the auger housing. This load bearing mounting of the screener drum on the input auger housing provides additional bearing support for the screener drum especially when the drum is loaded with grain.

An additional advantage of the screen drum support assembly is that grain will not leak from an opening between the end wall and the auger housing when the screen drum is loaded with grain. The support assembly has two annular plates which are attached to the end plate of the screener drum. These annular plates have a close fit around the input auger housing so that grain will not leak from an opening between the end wall and the auger housing.

This invention contemplates other objects, features and advantages which will become more fully apparent from the following detailed description taken in conjunction with the accompanying drawings.

BRIEF DESCRIPTION OF THE DRAWINGS

FIG. 1 is a perspective view of a rotary screener constructed in accordance with the principles of the invention;

FIG. 2 is a top view of the screener, partially in section;

FIG. 3 is a perspective view showing the screener drum of FIG. 1;

FIG. 6 is a perspective view showing the attachment of the upper auger housing with the screener drum;

FIG. 7 is a cross-sectional view showing the attachment of the auger housing with the screener drum;

FIG. 8 is an exploded view of the upper and lower auger housings and the auger supports; and FIG. 9 is an exploded view showing the auger assembly.

DESCRIPTION OF PREFERRED EMBODIMENT

Figure 4:
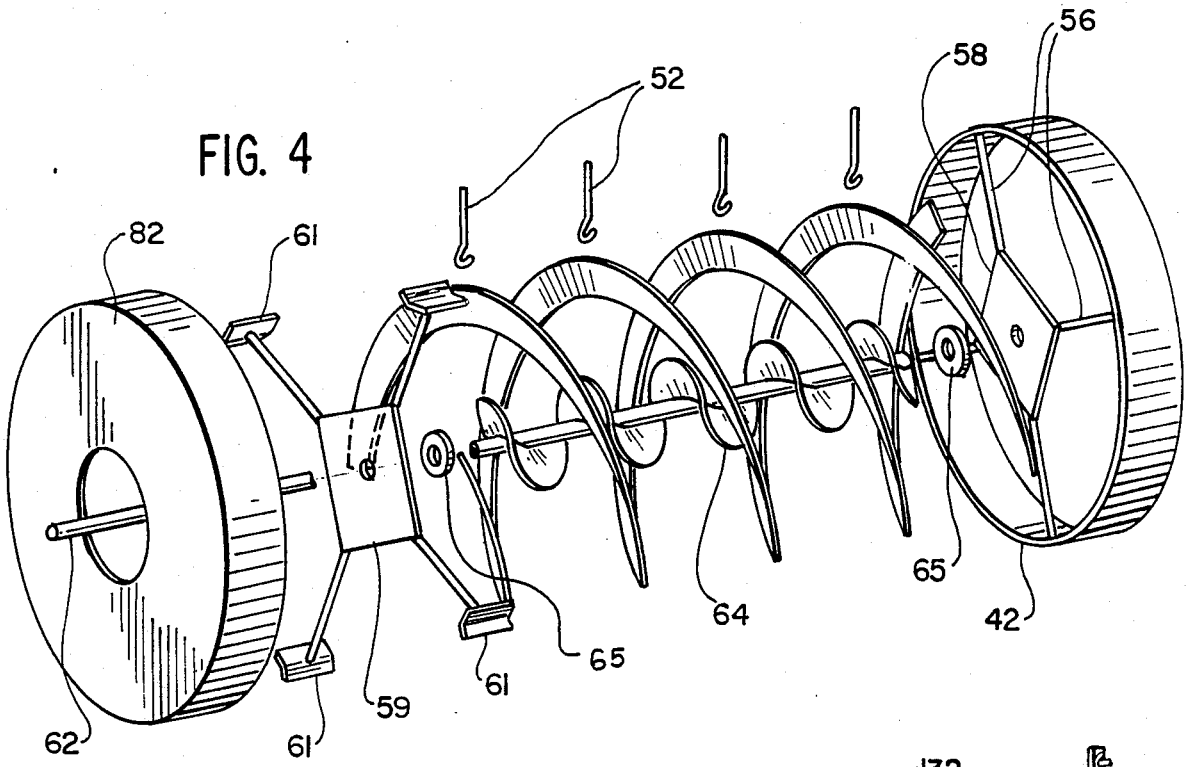
FIG. 4 is an exploded view of the screener drum.
Figure 5:
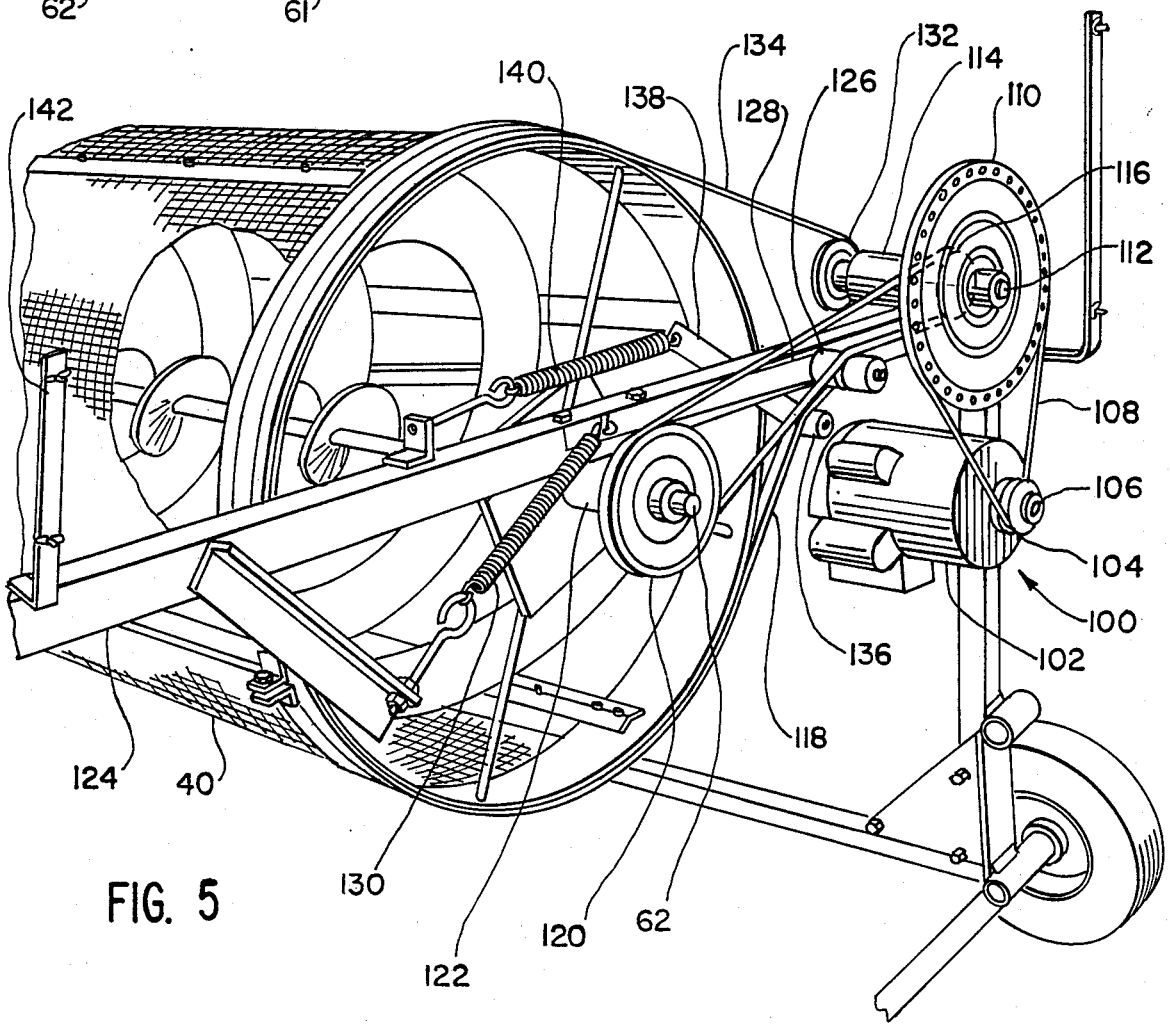
FIG. 5 is a rear perspective view of the grain screener with the protective housing structure removed to show drive components.

Reference numeral 10 generally designates a screener constructed in accordance with the principles of the invention. The screener 10 is designed for cleaning grain such as shelled corn, soybeans, wheat, oats and the like and it includes a frame structure generally designated by reference numeral 12 which is supported on a pair of wheels 14, a hitch 16 being provided for connection to a tractor or other vehicle to pull the screener to a desired operating location.

An auger assembly 18 is designed to move grain from a hopper 17 at the inlet end portion through a lower auger tube 21 and discharge from an upper auger tube 22 into the screener drum 24. The hopper and inlet end portion are in a low position such that grain can be dumped directly into the hopper from the discharge of gravity unload wagons. The lower auger tube 21 is attached to the hopper and to the upper auger tube 22. The upper auger tube 22 is supported by an auger tube support 20 which is attached to frame member 23. The upper auger tube 22 is also retained by the auger tube support band 19 which is positioned over the upper auger tube 22 and attached to the auger tube support 20.

As shown in FIGS. 1, 2 and 9, the auger assembly 18 has a lower auger 30 which is driven in tube 21 by a drive shaft 62 which runs along the central axis of the screener drum 24 with a U-joint knuckle connection 34 to allow for the change in angle between a lower auger shaft 33 and the drive shaft 62. The lower auger shaft 33 connects the U-joint knuckle connection 34 with the lower auger 30. The lower auger 30 is connected to a lower auger shaft 29 which is supported by a flange bearing 28 which is mounted on the hopper 17. The lower auger 30 could be combined with the lower auger shafts 29 and 30 to form a single component. The drive shaft 62 extends coaxially through the center of the upper auger 32 and the drive shaft 62 is attached to the upper auger 32. A flange bearing 60 supports drive shaft 62 on an end plate (not shown) secured in the inner end of upper auger tube 22. A discharge opening 63 through the lower inner end portion of the auger tube 22 permits discharge of material therefrom into the screener drum 24.

The grain to be cleaned is fed to the hopper 17 and conveyed through the upper auger tube 22 into a screener drum 24 which includes a cylindrical fine mesh screen 40 supported between a pair of axially spaced annular end rim portions 42 and 44. The fine mesh screen is of a mesh size suitable to pass the fine foreign materials and to retain the whole grain. The fine foreign material falls to the ground beneath the screening drum or may be received in the hopper of an appropriate separate take-away conveyor. The fine mesh screen 40 is attached to the annular end rim portions 42 and 44 by a pair of straps 46 and 48.

The fine mesh screen 40 is further attached to axially extending screener drum tumbler bars 54 and screen support bars 55, e.g. four (4) sets of such bars spaced at 90 degree positions about the screener drum. The mesh screen 40 is positioned over the screener drum tumbler bars 54. The screen support bars 55 are positioned over the mesh screen 40 and the screener drum tumbler bars 54. The screen support bars 55 are attached to the screener drum tumbler bars 54 by a series of bolts 53. Additional longitudinal screen support strips (not shown) may be interposed between the screen 40 and the flighting 48 and 50 at circumferential positions intermediate the bars 54, to avoid wear or cutting of the screen by the flighting.

The screener drum 24 further includes a pair of outer auger flighting 48 and 50 which form a double-flight helix and are supported by a series of hook bolts 52 which are attached to the screener drum tumbler bars 54. The outer auger flighting 48 and 50 advances the grain axially along the fine mesh screen 40 in a tumbling action as the drum is rotated. This ensures continuous movement of the grain and enhances the separation of the fine foreign material from the grain.

The pair of annular end rim portions 42 and 44 are attached to one another by the tumbler bars 54. The rim portion 42 is supported by radial spokes 56 which are connected to a center plate 58. The screener drum tumbler bars 54 also are attached to spoke support plates 61 which are supported by radial spokes 57. The spokes 57 are connected to a center plate 59.

The center plates 58 and 59 are attached to bearings 65 mounted on the drive shaft 62 for support purposes and to allow relative rotation between the drum 24 and the inner augers 32 and 64. The drive shaft 62 extends coaxially through center of the inner auger 64 and the inner auger 64 is attached to the drive shaft 62 between the center plates 58 and 59. The inner auger 64 prevents the plugging of the grain in the screener drum 24 and assists in spreading the grain along the length of the screener drum 24. The grain advances along the length of the screener drum 24 and is discharged from the outlet end of the screener drum 24 where it falls to the ground or preferably is received in the hopper of an appropriate take-away conveyor (not shown).

The screener drum 24 is supported both on the center drive shaft 62 at bearings 65 and also on the upper auger housing 22. The input end of the screening drum 24 is closed by an annular end plate 82 which is attached to the annular end rim portion 44. Referring particularly to FIG. 7, two annular plates 84 and 86 are bolted to the annular end plate 82 of the screener drum and have a relatively close fit around the upper auger housing 22 such that they provide bearing engagement on this housing 22, particularly when the screener drum is loaded with grain. These plates surround the tube 22 adjacent the support 20, where the tube defines a complete circular circumference, for supplemental support purposes and to effectively seal the end against leakage of the grain, even under loaded conditions. These plates preferably are made of a suitable plastic material, such as polyethylene, to provide an unlubricated bearing engagement on the auger housing. In an operative example, the upper auger housing is made from 14 gauge steel and the annular plates are made from a polyethylene described as a ultra high molecular weight and sold under number 05250AA-Z by Eiler Co. of Minneapolis, Minnesota, and formed a bearing opening of a nominal inside diameter about ⅛" greater than the nominal outside diameter of the tube 22.

Two complementary semicircular annular flanges 88 and 90 are mounted on the outside of the two annular plates 84 and 86 which are bolted to the end plate 82 with bolts 83 and nuts 85. The two annular plates 84 and 86 also prevent leakage of grain between the end plate 82 and the upper auger housing 22, such as can otherwise occur due to deflection and sagging of the screener drum and related components when the drum is loaded with grain.

The screener drum 24 and the drive shaft 62 are driven by the drive assembly 100. The drive assembly 100 includes an electric motor 102 with a pulley 104 secured to the shaft 106 of the motor. The pulley 104 is drivingly connected through a belt 108 to a second pulley 110 secured to a shaft 112 on an axis parallel to the axis of rotation of the first pulley 104.

The shaft 112 is journalled in a bearing 114 which is supported on a cross frame member 124. A third pulley 116 is secured to the shaft 112 and is drivenly connected through a second belt 118 to a fourth pulley 120 on an axis parallel to the axis of rotation of the third pulley 116. The fourth pulley 120 is secured to the drive shaft 62. The drive shaft 62 is journalled in a bearing 122 which is supported on the cross frame member 124.

An idler roller 126 engages the slack side of the second belt 118 and is carried at one end of a lever 128 which is pivotally mounted on the frame member 124. A tension spring 130 is connected to the opposite end of the lever 128 to urge the idler roller 126 into engagement with the second belt 118 for belt tension control.

A fifth pulley 132 is secured to the shaft 112 and is drivenly connected through a third belt 134 to the annular rim portion 44. An idler roller 136 engages the slack side of the third belt 134 and is carried at one end of a lever 138 which is pivotally mounted on the frame member 124. A tension spring 140 is connected to the opposite end of the lever 138 to urge the idler roller 136 into engagement with the third belt 134 for belt tension control.

The pulleys are so sized that the drive shaft 62 and the attached augers 30, 32 and 64 will rotate at an angular velocity substantially greater than that of the screener drum 24, e.g., approximately 5.3 times the speed of the screener drum 24. The higher angular velocity of the inner auger 64 will move and spread the grain and foreign materials forward in the drum at a greater rate than is accomplished by the pair of outer auger flighting 50.

The drive assembly 100 is covered by a shield 26 which is attached and supported by the shield supports 142 and 144. The shield supports 142 and 144 are connected to the frame member 124.

It will be understood that modifications and variations may be effected without departing from the spirit and scope of the novel concepts of this invention.

We claim:

1. A rotary grain screener comprising a screener drum including a cylindrical mesh screen, a plurality of axially spaced rim means supporting said mesh screen, frame means supporting said drum, drive means for rotating said drum, and a first conveying means for advancing the grain in the screener drum, a second conveying means within and disposed along a common axis with the screener drum for advancing the grain in the screener drum, said first conveying means comprising flighting adjacent to the inner peripheral surface of said screener drum, said flighting being rotatable with said drum and of a pitch to advance grain therein as the drum and flighting are rotated.

2. A rotary grain screener as defined in claim 1, further comprising a means for supplying grain to be cleaned through one end of said screener drum.

3. A rotary grain screener as defined in claim 1, wherein said second conveying means is an auger disposed along the axis of rotation of the screener drum.

4. A rotary grain screener as defined in claim 1, including means for rotating said auger at a greater angular velocity than said auger flighting adjacent to the inner peripheral surface of the screener drum.

5. A rotary grain screener as defined in claim 1, including means for operating said second conveying means to advance grain axially of the screener drum at a greater rate than the first conveying means.

6. A rotary grain screener as defined in claim 1, wherein said screener drum includes an end plate, an input auger including a housing communicating with said drum through said end plate, further comprising a bearing means for supporting the screener drum end plate on the input auger housing.

7. A rotary grain screener as defined in claim 6, wherein said bearing means for supporting the screener drum on the input auger housing comprises at least one annular plate attached to the end plate of the screener drum to engage the outer surface of the input auger housing.

8. A rotary grain screener as defined in claim 7, wherein at least one said annular plate is made from a nonmetallic material.

9. A rotary grain screener as defined in claim 1 further comprising an input auger for advancing grain into one end of said drum, a drive shaft which extends coaxially through the screener drum, a universal joint means which connects the drive shaft with the input auger, and a drive assembly connected to said drive shaft and to said drum whereby said drive means operates both said input auger and said screener drum.

10. A rotary grain screener as defined in claim 9, wherein said input auger extends at an angle to the axis of said screener drum.

11. A rotary grain screener as defined in claim 9, wherein said drive means is a single motive power source.

12. A rotary grain screener comprising a screener drum including a cylindrical mesh screen and an end closure, frame means supporting said drum, drive means for rotating said drum, and an input auger including a housing communicating with said drum through said end closure, said end closure having bearing engagement on said input auger housing.

13. A rotary grain screener as defined in claim 12 wherein said end closure includes at least a portion which is a nonmetallic material for such bearing engagement on said input auger housing.

14. A rotary grain screener as defined in claim 12, wherein said end closure includes a first end support and at least one annular plate attached to said first end support for such bearing engagement with the outer surface of said input auger housing.

15. A rotary grain screener as defined in claim 14, wherein at least one said annular plate is made from a nonmetallic material.

16. A rotary grain screener as defined in claim 15, wherein at least one said annular plate is made from a plastic material.

17. A rotary grain screener as defined in claim 14, wherein said first end support is an end plate.

* * * * *

UNITED STATES PATENT AND TRADEMARK OFFICE

CERTIFICATE OF CORRECTION

PATENT NO. : 4,919,642

DATED : April 24, 1990

INVENTOR(S) : Eugene G. Sukup, et al.

It is certified that error appears in the above-identified patent and that said Letters Patent is hereby corrected as shown below:

Column 2, line 34, after "drum" insert --of the machine--.

Signed and Sealed this

Thirtieth Day of July, 1991

*Attest:*

HARRY F. MANBECK, JR.

*Attesting Officer*

*Commissioner of Patents and Trademarks*